US011112218B2

(12) United States Patent
York et al.

(10) Patent No.: US 11,112,218 B2
(45) Date of Patent: Sep. 7, 2021

(54) MODULAR ARMOR

(71) Applicants: John York, Draper, UT (US); James Eckstein, Salt Lake City, UT (US)

(72) Inventors: John York, Draper, UT (US); James Eckstein, Salt Lake City, UT (US)

( * ) Notice: Subject to any disclaimer, the term of this patent is extended or adjusted under 35 U.S.C. 154(b) by 0 days.

(21) Appl. No.: 16/682,864

(22) Filed: Nov. 13, 2019

(65) Prior Publication Data

US 2021/0063116 A1 Mar. 4, 2021

Related U.S. Application Data

(60) Provisional application No. 62/760,751, filed on Nov. 13, 2018.

(51) Int. Cl.
*F41H 1/02* (2006.01)
*F41H 5/02* (2006.01)

(52) U.S. Cl.
CPC ..... *F41H 1/02* (2013.01); *F41H 5/023* (2013.01)

(58) Field of Classification Search
CPC ..... F41H 1/02; F41H 5/023
USPC ..... 89/36.01–36.17
See application file for complete search history.

(56) References Cited

U.S. PATENT DOCUMENTS 3,452,362 A * 7/1969 Korolick ..... F41H 1/02 2/2.5
4,351,558 A * 9/1982 Mueller ..... F41H 7/044 296/203.01
4,716,810 A * 1/1988 DeGuvera ..... F41H 5/013 109/83
5,600,084 A * 2/1997 Gonzalez ..... F41H 5/013 89/36.02
6,691,601 B2 * 2/2004 Cohen ..... F41H 5/06 109/49.5
8,069,768 B2 12/2011 Neal et al.
8,201,271 B2 * 6/2012 Dennis ..... F41H 1/02 2/102
8,201,279 B1 * 6/2012 Batstone ..... F41H 1/02 2/463
8,387,510 B1 3/2013 Martin et al.
8,464,493 B2 * 6/2013 Boone ..... E04B 1/3483 52/646
8,499,362 B2 * 8/2013 Dennis ..... F41H 1/02 2/102
8,757,041 B1 6/2014 Gillen
9,441,916 B2 * 9/2016 Seuk ..... F41H 1/02
9,700,122 B2 7/2017 Pelland et al.
(Continued)

FOREIGN PATENT DOCUMENTS

WO 2008130459 10/2008
WO 2014200592 12/2014

*Primary Examiner* — Samir Abdosh
(74) *Attorney, Agent, or Firm* — Snell & Wilmer LLP

(57) ABSTRACT

A modular armor apparatus includes a support plate and a plurality of replaceable armor modules coupled to the support plate. The armor modules may be detachably/reversibly coupled to the support plate to enable the armor modules to be replaced. In various embodiments, the support plate defines a plurality of first locking features, each armor module of the plurality of armor modules comprises a second locking feature, and the second locking feature of each armor module is configured to be reversibly interlocked with a respective first locking feature of the plurality of first locking features of the support plate.

17 Claims, 5 Drawing Sheets

(56) References Cited

U.S. PATENT DOCUMENTS

| | | | | |
|---|---|---|---|---|
| 9,823,050 | B2 * | 11/2017 | Martinez | F41H 1/02 |
| 2004/0020354 | A1 * | 2/2004 | Ravid | F41H 5/013 89/36.02 |
| 2010/0037761 | A1 * | 2/2010 | Boczek | F41H 7/044 89/36.08 |
| 2010/0077913 | A1 * | 4/2010 | Cunningham | F41H 7/048 89/36.08 |
| 2011/0072546 | A1 * | 3/2011 | Taylor | F41H 1/02 2/2.5 |
| 2011/0231976 | A1 * | 9/2011 | Herbener | A41F 1/008 2/2.5 |
| 2012/0180178 | A1 * | 7/2012 | Gallo | F41H 1/02 2/2.5 |
| 2016/0003581 | A1 * | 1/2016 | Warren | A41D 13/055 2/2.5 |
| 2016/0033235 | A1 * | 2/2016 | Kinnings | F41H 1/02 2/102 |
| 2016/0273886 | A1 | 9/2016 | O'Neal | |

* cited by examiner

MODULAR ARMOR

CROSS-REFERENCE TO RELATED APPLICATIONS

This application claims priority to U.S. Provisional Patent Application Ser. No. 62/760,751, entitled "MODULAR ARMOR," filed on Nov. 13, 2018, the entire contents of which is incorporated by reference in its entirety.

FIELD

This disclosure relates to body armor, and more particularly to modular body armor.

BACKGROUND

Body armor generally refers to protective clothing that is designed to absorb and/or deflect slashing, bludgeoning, and/or penetrating attacks from weapons and/or projectiles. Other types of armor, such as protective plating or other defensive shielding, can be used to protect aircraft, tanks, vehicles, buildings, and other structures. Armor has been historically used to protect military personnel and military property, whereas today it is also used to protect law enforcement, private citizens, private security guards, and/or bodyguards, among others.

SUMMARY

In various embodiments, the present disclosure provides a modular armor apparatus. The modular armor apparatus may include a support plate and a plurality of replaceable armor modules coupled to the support plate. That is, the armor modules may be detachably/reversibly coupled to the support plate to enable the armor modules to be replaced. In various embodiments, the support plate defines a plurality of first locking features, each armor module of the plurality of armor modules comprises a second locking feature, and the second locking feature of each armor module is configured to be reversibly interlocked with a respective first locking feature of the plurality of first locking features of the support plate.

In various embodiments, the plurality of first locking features comprises a plurality of receptacles defined in the support plate and the second locking feature of each armor module comprises a stud extending from the back side. The stud of each armor module may be reversibly retained within a respective receptacle of the plurality of receptacles of the support plate. In various embodiments, the front side of each armor module is oblique relative to a plane of the support plate. In various embodiments, the front side of each armor module comprises a domed, convex shape.

In various embodiments, the support plate comprises a front surface and a back surface, and the plurality of first locking features comprises a plurality of pass-through apertures extending through the support plate from the front surface to the back surface. The back surface of the support plate may define a plurality of indentations corresponding to the plurality of pass-through apertures. In various embodiments, each indentation of the plurality of indentations surrounds and circumscribes a respective pass-through aperture of the plurality of pass-through apertures. In various embodiments, the plurality of indentations comprises indentations of different sizes. In various embodiments, a cross-sectional size of each indentation is proportional to a cross-sectional size of the respective pass-through aperture. In various embodiments, a shape of a perimeter of each indentation is different than a cross-sectional shape of the respective pass-through aperture.

In various embodiments, the second locking feature of each armor module comprises a stud extending from the back side. The stud may be configured to extend through a respective pass-through aperture of the plurality of pass-through apertures such that the back side each armor module engages the front surface of the support plate. The modular armor apparatus may further include a locking nut that is configured to be coupled to the stud and to be seated within a respective indentation of the plurality of indentations. In various embodiments, a portion the stud comprises a non-circular cross-sectional shape. In various embodiments, the non-circular cross-sectional shape matches a cross-sectional shape of the respective pass-through aperture such that each armor module is positioned in a desired orientation relative to the support plate. In various embodiments, the portion of the stud is a first portion, wherein the stud further comprises a second portion comprising a circular cross-sectional shape.

Also disclosed herein, according to various embodiments, is a modular armor apparatus that includes a support plate and a plurality of armor modules. The support plate may comprise a front surface, a back surface, and a plurality of first locking features. The plurality of armor modules may be detachably coupled to the support plate, wherein each armor module of the plurality of armor modules may comprise a second locking feature configured to reversibly interlocked with a respective first locking feature of the plurality of first locking features of the support plate.

In various embodiments, the plurality of first locking features comprises a plurality of pass-through apertures extending the support plate from the front surface to the back surface and the back surface of the support plate defines a plurality of indentations corresponding to the plurality of pass-through apertures. In various embodiments, each armor module comprises a back side and a front side opposite the back side and the second locking feature of each armor module comprises a stud extending from the back side. In various embodiments, the stud is configured to extend through a respective pass-through aperture of the plurality of pass-through apertures such that the back side each armor module engages the front surface of the support plate and a locking nut is configured to be coupled to the stud and to be seated within a respective indentation of the plurality of indentations. In various embodiments, a first portion the stud comprises a non-circular cross-sectional shape, the non-circular cross-sectional shape matches a cross-sectional shape of the respective pass-through aperture such that each armor module is positioned in a desired orientation relative to the support plate, and a second portion of the stud comprises a circular cross-sectional shape configured to be coupled to the locking nut.

Also disclosed herein, according to various embodiments, is a method of repairing body armor. The method may include decoupling any remaining portions of a broken armor module from a first locking feature of a support plate and engaging a second locking feature of a replacement armor module with the first locking feature. Engaging the second locking feature with the first locking feature comprises inserting a stud of the replacement armor module into at least one a receptacle and a pass-through aperture forming the first locking feature, according to various embodiments. Engaging the second locking feature with the first locking feature may include coupling a locking nut to the stud of the replacement armor module after inserting the stud through the pass-through aperture forming the first locking feature.

The forgoing features and elements may be combined in various combinations without exclusivity, unless otherwise expressly indicated herein. These features and elements, as well as the operation of the disclosed embodiments, will become more apparent in light of the following description and accompanying drawings.

Figures 1, 2, 3, 4:
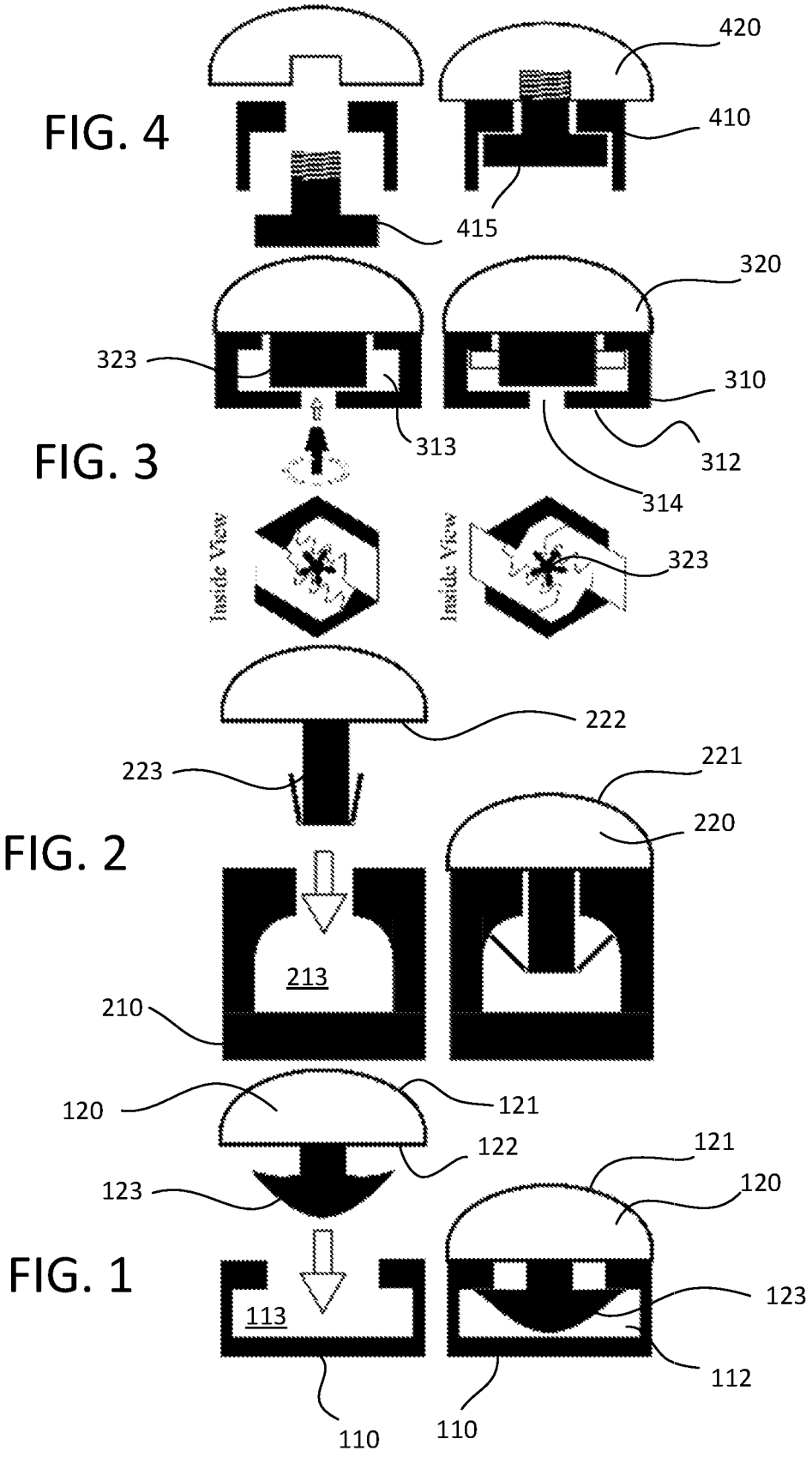
FIGS. 1, 2, 3, and 4 are schematic depictions of mechanisms for coupling individual armor modules to a support plate of a modular armor apparatus, in accordance with various embodiments.
Figure 5A:
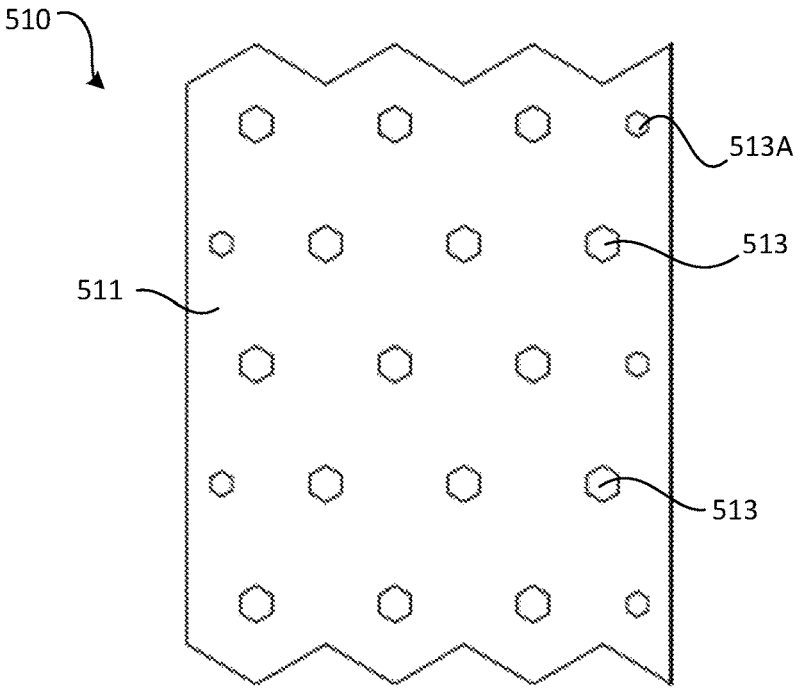
FIGS. 5A and 5B are front views of a support plate of a modular armor apparatus, in accordance with various embodiments.
Figure 5B:
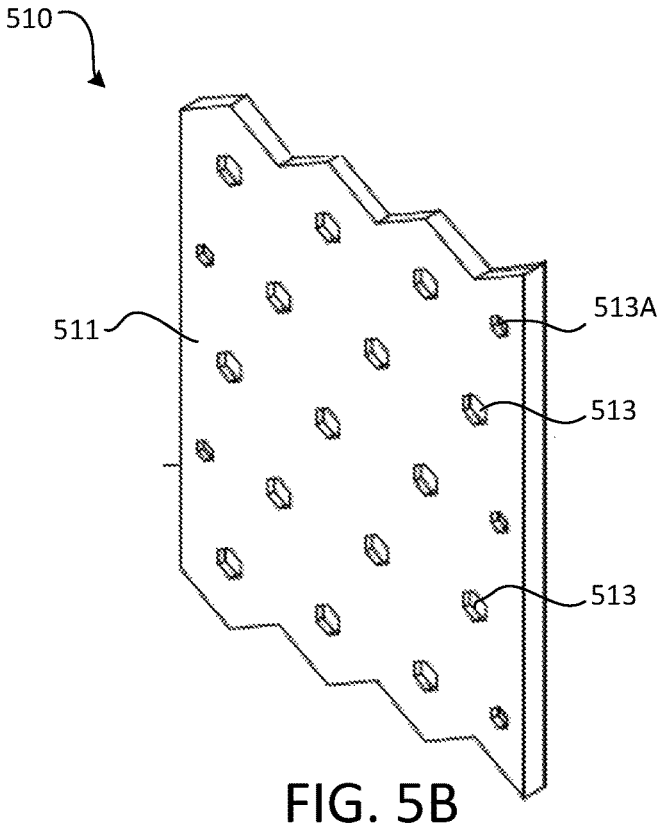
Figure 5C:
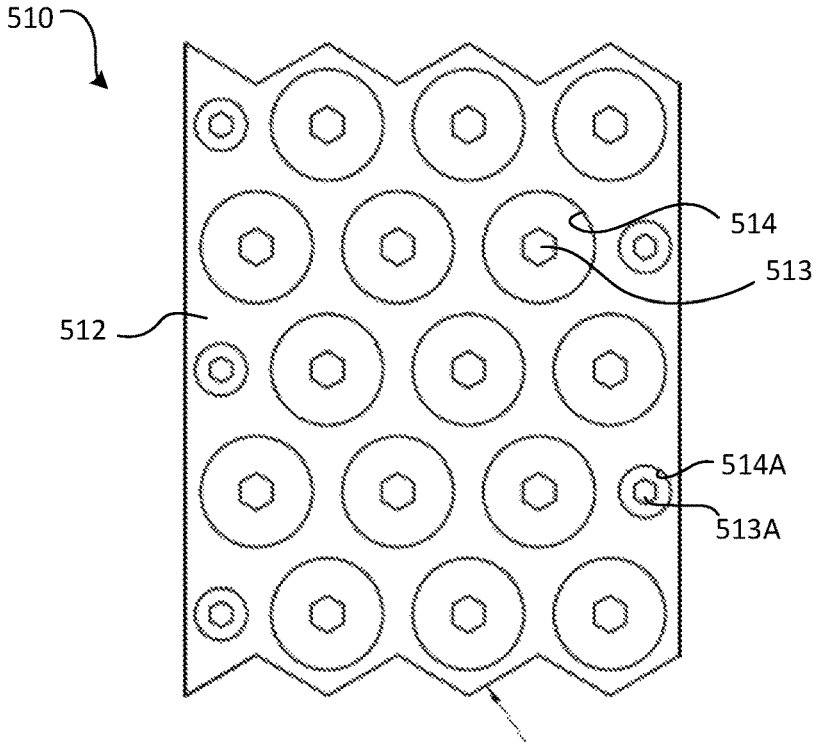
FIGS. 5C and 5D are back views of a support plate of a modular armor apparatus, in accordance with various embodiments.
Figure 5D:
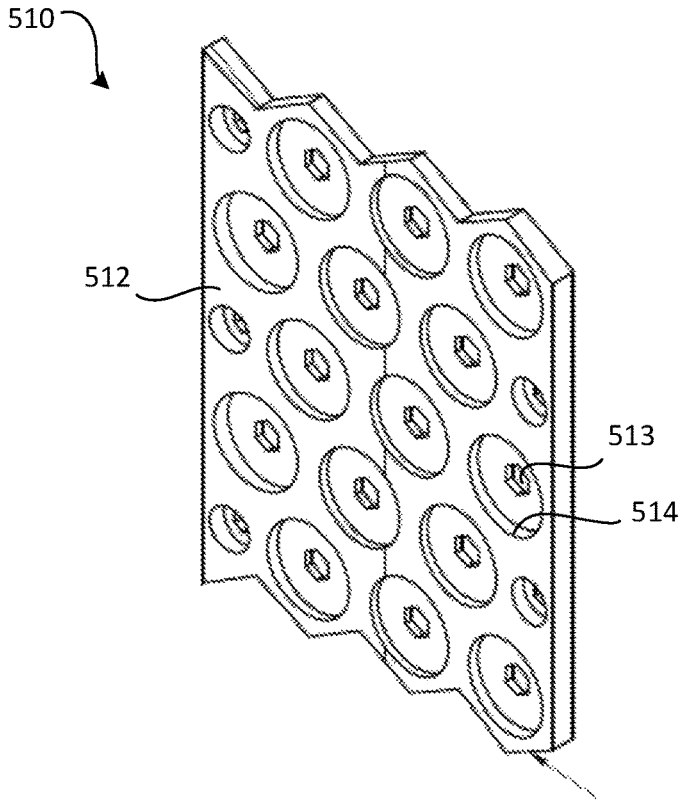

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

In various embodiments, the present disclosure provides a modular armor apparatus that includes a support plate and a plurality of replaceable armor modules coupled to the support plate. The modular armor apparatus, may be implemented as personal, wearable body armor for people, or the modular armor apparatus may be implemented as an armor/shielding system for vehicles, aircraft, structures, etc. Generally, the replaceable armor modules are detachably or otherwise reversibly coupled to the support plate, enabling a user to swap or replace broken, damaged, or otherwise structurally compromised armor modules.

In various embodiments, the armor modules of the modular armor apparatus for a protective grid or pattern across the support plate. For example, the armor modules may be hexagon shaped and may be disposed substantially adjacent each other in a matrix of substantially abutting components. In various embodiments, the support plate defines a plurality of first locking features. Each armor module of the plurality of armor modules may have a back side and a front side opposite the back side, with each armor module of the plurality of armor modules having a second locking feature. In various embodiments, the second locking feature of each armor module is reversibly interlocked with a respective first locking feature of the plurality of first locking features of the support plate. Examples of various interlocking engagement structures for the locking plate and individual armor modules are described in greater detail below with reference to FIGS. 1-4, details pertaining to various embodiments of a support plate are included below with reference to FIGS. 5A, 5B, 5C, and 5D, and details pertaining to armor modules are included below with reference to FIGS. 6A, 6B, and 7.

The support plate and/or the armor modules may be made from metallic materials, ceramic materials, metal-ceramic composite materials, and/or fiber composite materials, among others. In various embodiments, the armor modules are made from a ballistic material. In various embodiments, the armor modules and the support plate are produced separately and assembled for distribution. In various embodiments, the front side of the armor modules (i.e., the side that faces outward and away from the support plate) is oblique relative to the support plate. That is, the front side of the armor modules may be slanted, curved, or otherwise non-parallel to the longitudinal anatomic plane of the underlying support plate. For example, the front side of the armor modules may have a domed, convex shape.

In various embodiments, the support plate (e.g., the front surface of the support plate) has a plurality of first locking features that correspond to the plurality of armor modules, as mentioned above. The back side of each armor module may have a second locking feature that respectively engages the first locking features of the support plate. In various embodiments, the plurality of first locking features comprises a plurality of receptacles defined in the support plate, the second locking feature of each armor module comprises a stud (e.g., a protruding feature) extending from the back side, and the stud of each armor module is reversibly retained within a respective receptacle of the plurality of receptacles of the support plate. That is, the armor modules may each have a stem that is received and reversibly retained within a corresponding receptacle or socket of the support plate.

In various embodiments, the modular armor apparatus further includes a plurality of fasteners or other retention mechanisms for securing the armor modules to the support plate. In various embodiments, and with reference to FIG. 1, the back side 122 of each armor module 120 may have a stud 123, such as a rubber element, that is receivable within a receptacle 113 defined within the support plate 110. As mentioned above, the front side 121 of each armor module 120 may have a domed, convex shape to help deflect projectiles and/or other attacks. In various embodiments, and with reference to FIG. 2, the back side 222 of each armor module 220 may have a stem with a flap feature 223, and the flaps 223 may facilitate retention of the stem within the receptacle 213 of the support plate 210.

In various embodiments, and with reference to FIG. 3, the stem 323 of the armor module may include a gear mechanism. Once the geared stem 323 is inserted through a hole in the front side of the support plate 310, the geared stem 323 may be actuated using a tool inserted via a hole 314 defined in the back side 312 of the support plate 310. Actuation of the geared stem 323 may cause flaps or other retention features to protrude radially outward and thus be retained within the receptacle 313 of the support plate 310. In various embodiments, and with reference to FIG. 4, a bolt or other such fastener 415 may be inserted through a back side of the support plate 410, and may be coupled to a corresponding feature of the back side of the armor module 420. In various embodiments, the arrangement of FIG. 4 may be reversed, with the stem extending from the armor module and a nut or other feature being coupled to the stem and retained within the receptacle or against the back side of the support plate. The scope of the present disclosure is not limited to the figures and the embodiments described. That is, other retention mechanisms and other configurations, as recognized by those of ordinary skill in the arm, fall within the scope of the present disclosure.

In various embodiments, and with reference to FIGS. 5A, 5B, 5C, and 5D, front and back views of the support plate 510 are provided. The support plate 510 may have a front surface 511 and a back surface 512. The plurality of first locking features may be a plurality of pass-through apertures 513. That is, the support plate 510 may define a plurality of pass-through apertures 513 that extend completely through the support plate 510 from the front surface 511 to the back surface 512. In various embodiments, the back surface 512 of the support plate 510 defines a plurality of indentations 514. The plurality of indentations correspond to the plurality of pass-through apertures 513. For example, each indentation 514 may surround and circumscribe a respective pass-through aperture 513.

In various embodiments, the pass-through apertures 513 do not have the same cross-sectional size or shape. For example, some of the apertures, such as aperture 513A, may have a smaller cross-sectional dimension than other apertures 513. A similar configuration may be implemented for the size of the indentations 514. That is, certain indentations may be smaller than others. In various embodiments, the support plate 510 may have pass-through apertures 513 and indentations 514 that are proportional to each other. That is, the larger apertures 513 may have correspondingly larger indentations 514 and the smaller apertures 513A may have correspondingly smaller indentations 514A. In various embodiments, a shape of a perimeter of the indentations 514 is different than a cross-sectional shape of the respective pass-through aperture 513. For example, the indentations 514 may have a circular perimeter/shoulder and the apertures 513 may have a hexagonal perimeter/cross-section.

Figure 6A:
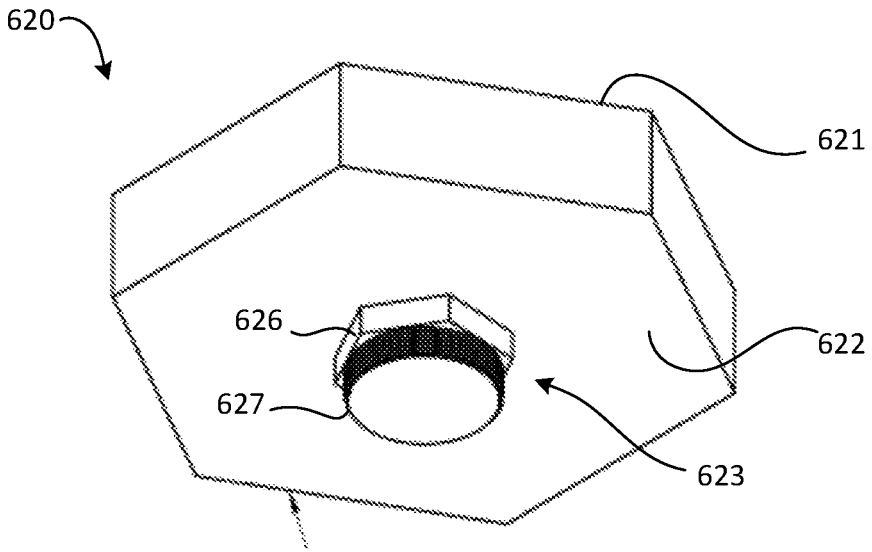
FIGS. 6A and 6B are views of an armor module of a modular armor apparatus, in accordance with various embodiments.
Figure 6B:
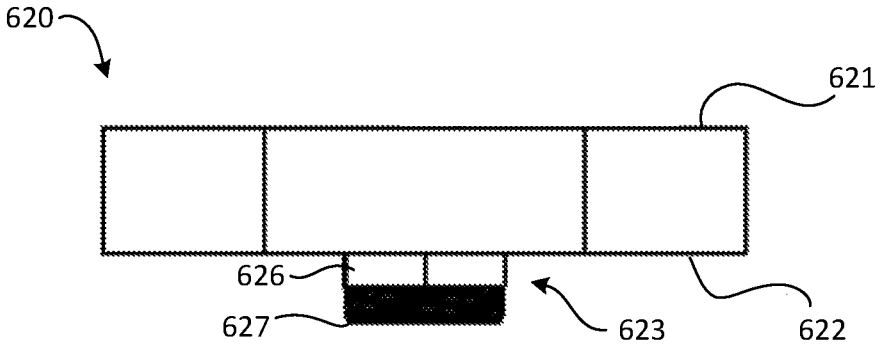
Figure 7:
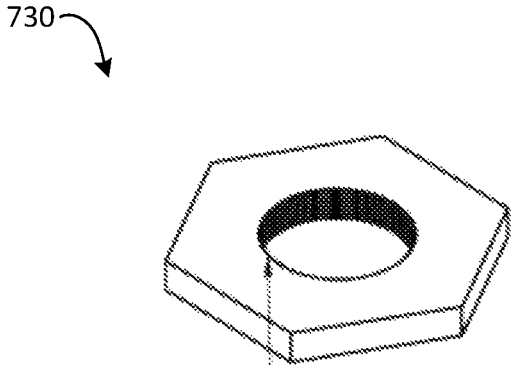
FIG. 7 is a s view of a locking nut of a modular armor apparatus, in accordance with various embodiments.

In various embodiments, and with reference to FIGS. 6A, 6B, and 7, an armor module 620 is provided. The second locking feature of the armor module 620, which is configured to engage with a respective first locking feature of the support plate, may include a stud 623 extending from a back side 622 of the armor module 620. That is, the armor module 620 may have a front side 621 and a back side 622, with the stud 623 extending from the back side 622 and configured to be received into a respective aperture 513 of the plurality of apertures of the support plate 510 such that the back side 622 of each armor module 620 engages the front surface 511 of the support plate 510. In various embodiments, and with specific reference to FIG. 7, a locking nut 730 is provided. The locking nut 730 may be configured to be coupled to the stud 623 and to be seated within a respective indentation 514. Accordingly, the armor module 620 may be retained against the support plate 510 by sandwiching the support plate 510 between the back side of the armor module 622 and the locking nut 730.

In various embodiments, a portion 626 of the stud 623 has a non-circular cross-sectional shape. This portion 626 of the stud 623 may match/contour a cross-sectional shape of the respective pass-through aperture 513. Engagement of the non-circular portion 626 of the stud 623 with the correspondingly non-circular shape of the aperture 513 may facilitate retaining the armor module in a desired position/orientation, which may facilitate the armor modules 620 properly spanning across (e.g., covering) the front surface of the support plate. In various embodiments, the non-circular portion 626 is a first portion of the stud 623, and the stud also comprises a second portion 627 that is circular. This second portion 627 may be threaded and may be the portion of the stud 623 to which the locking nut 730 is attached.

Figure 8:
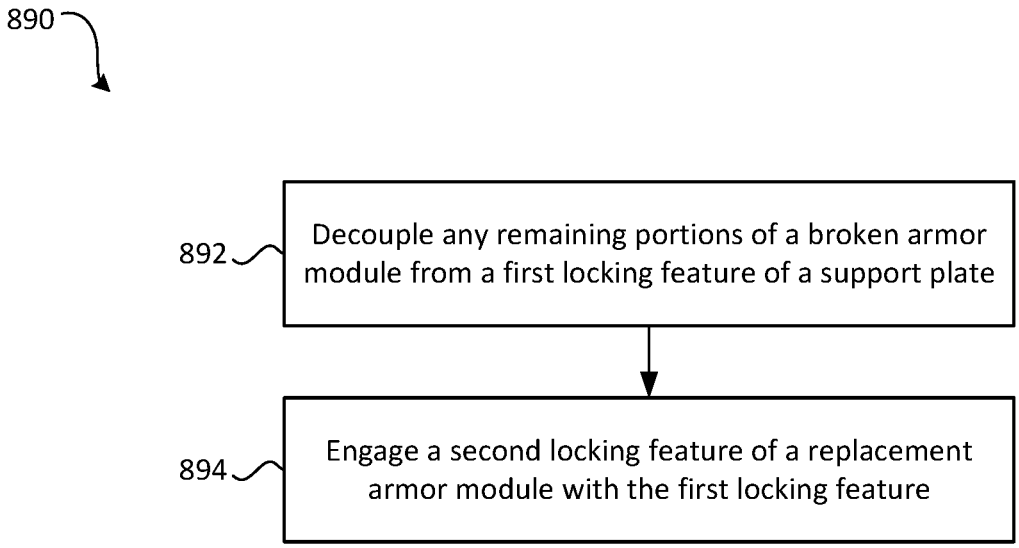
FIG. 8 is a schematic block diagram of a method of repairing body armor, in accordance with various embodiments.

In various embodiments, and with reference to FIG. 8, a method 890 of repairing body armor is provided. The method may include decoupling any remaining portions of a broken armor module from a first locking feature of a support plate at step 892 and engaging a second locking feature of a replacement armor module with the first locking feature at step 894. Step 894 may include inserting a stud of the replacement armor module into at least one a receptacle and a pass-through aperture forming the first locking feature. In various embodiments, step 894 includes coupling a locking nut to the stud of the replacement armor module after inserting the stud through the pass-through aperture forming the first locking feature.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A modular armor apparatus comprising:

a support plate defining a plurality of first locking features; and a plurality of replaceable armor modules coupled to the support plate;

wherein each armor module of the plurality of armor modules comprises a back side and a front side opposite the back side;

each armor module of the plurality of armor modules comprises a second locking feature;

the second locking feature of each armor module is configured to be reversibly interlocked with a respective first locking feature of the plurality of first locking features of the support plate;

the plurality of first locking features comprises a plurality of receptacles defined in the support plate;

the second locking feature of each armor module comprises a stud extending from the back side; and the stud of each armor module is reversibly retained within a respective receptacle of the plurality of receptacles of the support plate.

2. The modular armor of claim 1, wherein the front side of each armor module is oblique relative to a plane of the support plate.

3. The modular armor of claim 1, wherein the front side of each armor module comprises a domed, convex shape.

4. The modular armor apparatus of claim 1, wherein:

the support plate comprises a front surface and a back surface;

the plurality of receptacles comprises a plurality of pass-through apertures extending through the support plate from the front surface to the back surface; and the back surface of the support plate defines a plurality of indentations corresponding to the plurality of pass-through apertures.

5. The modular armor apparatus of claim 4, wherein each indentation of the plurality of indentations surrounds and circumscribes a respective pass-through aperture of the plurality of pass-through apertures.

6. The modular armor apparatus of claim 5, wherein the plurality of indentations comprises indentations of different sizes.

7. The modular armor apparatus of claim 5, wherein a cross-sectional size of each indentation is proportional to a cross-sectional size of the respective pass-through aperture.

8. The modular armor apparatus of claim 7, wherein a shape of a perimeter of each indentation is different than a cross-sectional shape of the respective pass-through aperture.

9. The modular armor apparatus of claim 5, wherein:

the second locking feature of each armor module comprises a stud extending from the back side;

the stud is configured to extend through a respective pass-through aperture of the plurality of pass-through apertures such that the back side each armor module engages the front surface of the support plate; and a locking nut is configured to be coupled to the stud and to be seated within a respective indentation of the plurality of indentations.

10. The modular armor apparatus of claim 9, wherein a portion the stud comprises a non-circular cross-sectional shape.

11. The modular armor apparatus of claim 10, wherein the non-circular cross-sectional shape matches a cross-sectional shape of the respective pass-through aperture such that each armor module is positioned in a desired orientation relative to the support plate.

12. The modular armor apparatus of claim 11, wherein the portion of the stud is a first portion, wherein the stud further comprises a second portion comprising a circular cross-sectional shape.

13. A modular armor apparatus comprising:

a support plate comprising a front surface, a back surface, and a plurality of first locking features; and a plurality of armor modules detachably coupled to the support plate, wherein each armor module of the plurality of armor modules comprises a second locking feature configured to reversibly interlocked with a respective first locking feature of the plurality of first locking features of the support plate;

wherein:

the plurality of first locking features comprises a plurality of pass-through apertures extending the support plate from the front surface to the back surface;

the back surface of the support plate defines a plurality of indentations corresponding to the plurality of pass-through apertures;

each armor module comprises a back side and a front side opposite the back side;

the second locking feature of each armor module comprises a stud extending from the back side;

the stud is configured to extend through a respective pass-through aperture of the plurality of pass-through apertures such that the back side each armor module engages the front surface of the support plate; and a locking nut is configured to be coupled to the stud and to be seated within a respective indentation of the plurality of indentations.

14. The modular armor apparatus of claim 13, wherein:

a first portion the stud comprises a non-circular cross-sectional shape;

the non-circular cross-sectional shape matches a cross-sectional shape of the respective pass-through aperture such that each armor module is positioned in a desired orientation relative to the support plate; and a second portion of the stud comprises a circular cross-sectional shape configured to be coupled to the locking nut.

15. A method of repairing body armor, the method comprising:

decoupling any remaining portions of a broken armor module from a first locking feature of a support plate; and engaging a second locking feature of a replacement armor module with the first locking feature;

wherein:

the replacement armor module comprises a back side and a front side opposite the back side;

the second locking feature of the replacement armor module is configured to be reversibly interlocked with the first locking feature of the support plate;

the support plate comprises a front surface and a back surface;

the first locking feature comprises a pass-through aperture extending through the support plate from the front surface to the back surface; and the back surface of the support plate defines an indentation corresponding to the pass-through aperture.

16. The method of claim 15, wherein engaging the second locking feature with the first locking feature comprises inserting a stud of the replacement armor module into the pass-through aperture.

17. The method of claim 16, wherein engaging the second locking feature with the first locking feature comprises coupling a locking nut to the stud of the replacement armor module after inserting the stud through the pass-through aperture forming the first locking feature.

* * * * *